US006044558A

United States Patent [19]

Wu

[11] Patent Number: 6,044,558

[45] Date of Patent: Apr. 4, 2000

[54] COMBINATION OF HAIR COMBING TRIMMER, SHAVER, AND HEAD SIDE PROFILE CUTTER

[75] Inventor: Jack Wu, Taipei, Taiwan

[73] Assignee: Modas Shing Company Ltd., Taipei, Taiwan

[21] Appl. No.: 09/037,818

[22] Filed: Mar. 10, 1998

[51] Int. Cl.[7] ..... B26B 19/06

[52] U.S. Cl. ..... 30/34.1; 30/220; 30/233.5

[58] Field of Search ..... 30/34.1, 43.6, 30/43.9, 43.92, 233.5, 346.51, 200, 210, 216, 220

[56] References Cited

U.S. PATENT DOCUMENTS

| | | | |
|---|---|---|---|
| 3,233,324 | 2/1966 | Der Heide | 30/34.1 |
| 3,364,569 | 1/1968 | Dokos et al. | 30/34.1 |
| 3,421,215 | 1/1969 | Bauer | 30/34.1 |
| 3,874,079 | 4/1975 | Waters et al. | 30/34.1 |
| 4,043,036 | 8/1977 | Stevens, Sr. et al. | 30/43.6 |
| 5,014,428 | 5/1991 | Yamashita | 30/43.6 |
| 5,060,380 | 10/1991 | Fujikawa | 30/233.5 |
| 5,408,749 | 4/1995 | Momose | 30/43.6 |

*Primary Examiner*—Hwei-Siu Payer
*Attorney, Agent, or Firm*—Bacon & Thomas

[57] ABSTRACT

A combination of hair combing trimmer, shaver, and head side profile cutter includes a main body and a cutting head. The main body has a power supply and transmission unit mounted therein and defines a reservoir therein for receiving hair clippings. The cutting head, being selected from the group consisting of a hair combing trimmer, a shaver, and a head side profile cutter, includes a housing, a blade mounted in the housing, and a comb mounted on the cutting head for cooperation with the blade for trimming hair. The primary feature of the present invention resides in that the combination device is made in a separable form that allows a first cutting head to be integrally removed from the main body to be replaced with a second cutting head.

12 Claims, 12 Drawing Sheets

COMBINATION OF HAIR COMBING TRIMMER, SHAVER, AND HEAD SIDE PROFILE CUTTER

BACKGROUND OF THE INVENTION

The present invention relates to a combination of hair combing trimmer, shaver, and head side profile cutter, and more particularly to a cutting device combination that is made in a separable form that allows a first cutting head thereof to be integrally removed from a main body thereof to be replaced with a second cutting head.

It is found that a conventional hair combing trimmer (see FIG. 13) and a conventional head side profile cutter (see FIG. 14) are each made integrally with its respective main body, so that a user has to employ at least one conventional trimmer and at least one conventional profile cutter respectively to trim different sections of the hair conveniently, for example: the crown section, the back section, or the side section of the head, and the chin which results in inconvenience and additional expense.

In view of this, the applicant has invented a combination of hair combing trimmer, shaver, and head side profile cutter to alleviate the above problem.

SUMMARY OF THE INVENTION

The primary object is to provide a cutting device combination, which comprises a main body and a cutting head. The main body has a power supply and transmission unit mounted therein and defines a reservoir therein for receiving hair clippings. The cutting head, being selected from the group consisting of a hair combing trimmer, a shaver, and a head side profile cutter, includes a housing, a blade mounted in the housing, and a comb mounted on the cutting head housing for cooperation with the blade for trimming hair. The comb is arranged to space from the blade at a predetermined controllable distance whereby the cutting blade may conduct a cutting movement via the power supply and transmission unit, whereby the hair is allowed to be trimmed by the blade at a desired length by adjusting the distance between the comb and the blade. The primary feature of the present invention resides in that: the cutting device combination is made in a separable form that allows a first cutting head to be integrally removed from the main body to be replaced with a second cutting head.

A second object of the present invention is to provide a profile cutter adapted to be mounted on a main body for cutting the side hair section of the head. The profile cutter comprises a housing, a converting mechanism, a first elongate blade, and a second elongate blade. The housing includes a bottom portion, a first portion, and a second wall portion. The bottom portion includes a first half bottom portion and a second half bottom portion, which defines a lower space. The first wall portion is integrally formed with the first half bottom portion. The second wall portion, which is integrally formed with the second half bottom portion, is releasably mounted with the first wall portion to define an upper space therein and an elongate slot along the top edges of the first wall portion and the second wall portion. The converting mechanism is mounted in the lower space defined in the bottom portion which is adapted to be driven into movement by a power supply and transmission unit. The first elongate blade is fixedly mounted to one of the first wall portion and the second wall portion along the top edge thereof. The first elongate blade has a plurality of consecutive teeth formed thereon, each tooth being arranged to project from the respective top edge of the first wall portion and the second wall portion. The second elongate blade is spring-baisedly mounted to one of the first wall portion and the second wall portion, adjacent to and flush with the first elongate blade. The second elongate blade is reciprocally moved relative to the first elongate blade. The second elongate blade has a plurality of consecutive teeth. In such an arrangement, the reciprocal movement of the second elongate blade relative to the first elongate blade may cause hair or sideburns to be trimmed to a desired hair style.

Other novel features and advantages of the invention will become more apparent from the following detailed description when taken in conjunction with the accompanying drawings.

DETAILED DESCRIPTION OF THE PREFERRED EMBODIMENT

Figure 1:
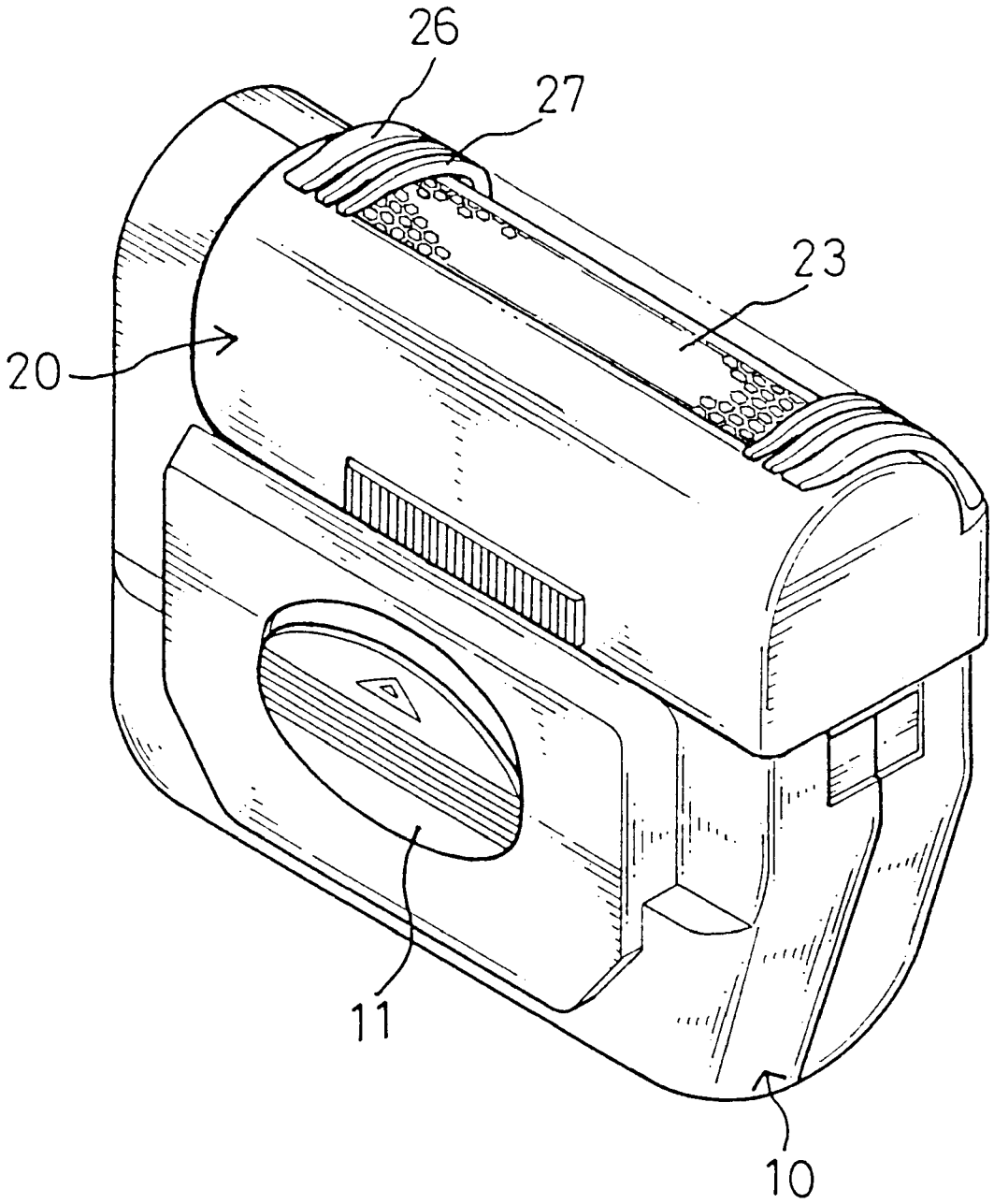
FIG. 1 is a perspective view of a first assembly of a cutting device combination in accordance with the present invention, in which a hair combing trimmer is mounted.
Figure 2:
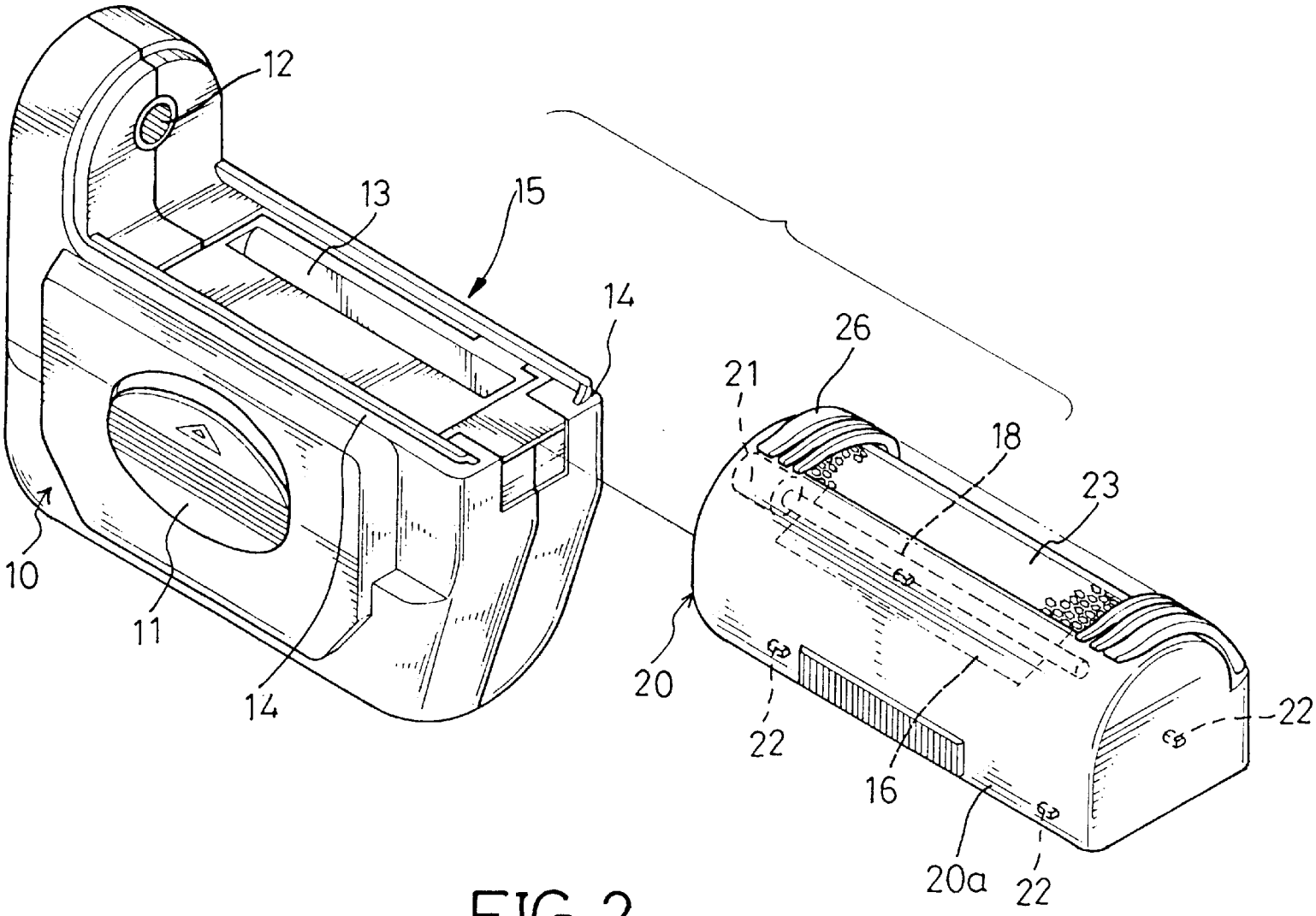
FIG. 2 is an exploded view of the first assembly.
Figure 3:
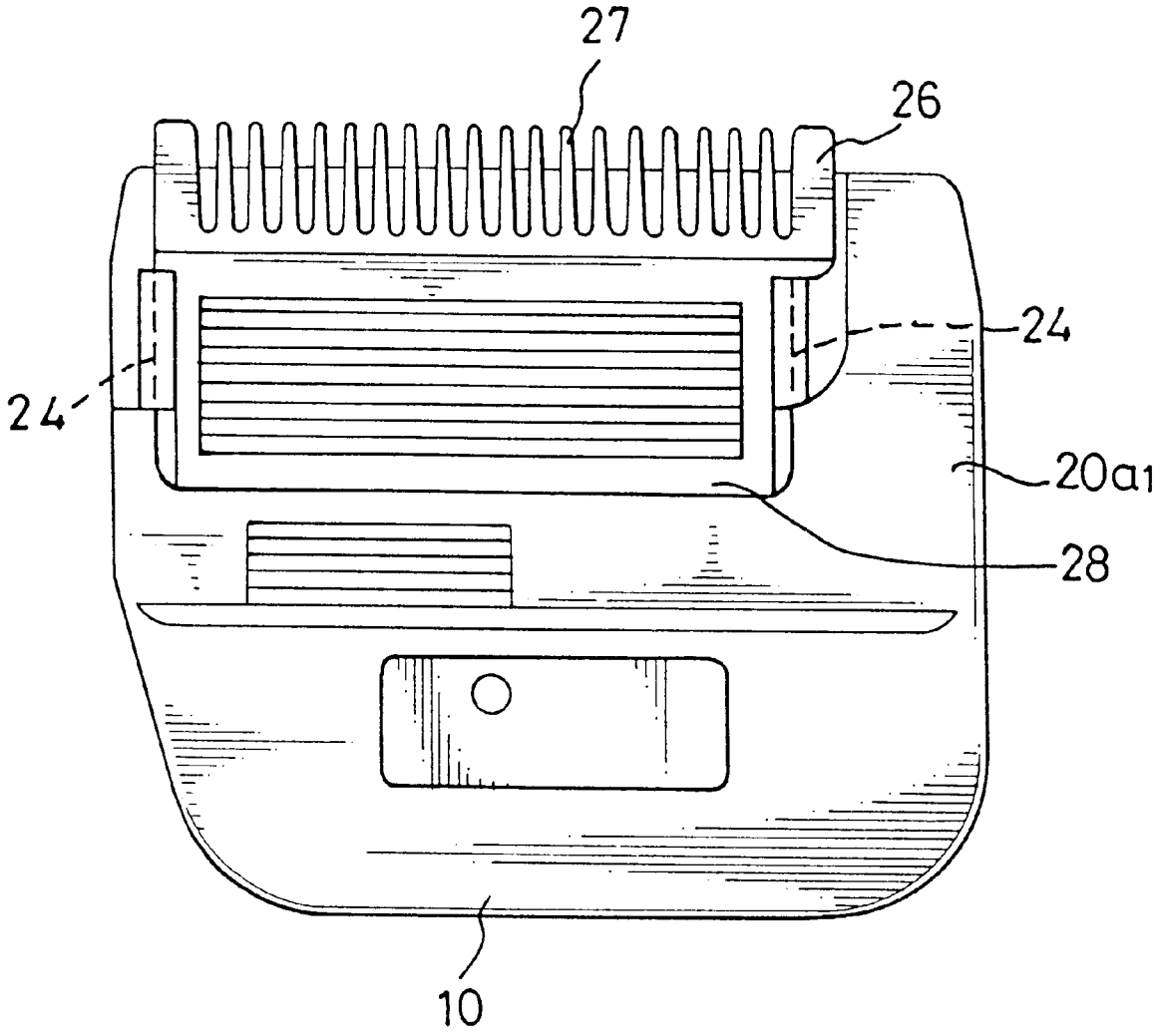
FIG. 3 is a plan view of the first assembly.

Referring to FIGS. 1 and 2, a first assembly of a combination of hair combing trimmer, shaver and head side profile cutter in accordance with the present invention is disclosed, which generally comprises a main body 10 and a hair combing trimmer, 20. The main body 10 has a power supply and transmission unit (not shown) mounted therein which is actuated by a switch 11, as can be seen in conventional trimmers or shavers, and defines a reservoir 13 therein for receiving hair clippings. The hair combing trimmer 20 includes a housing 20*a,* a blade 16 mounted in the trimmer housing 20*a,* as can be seen in conventional trimmers or shavers, and a comb 26 mounted on the trimmer housing 20*a* for cooperation with the blade (not shown) mounted in the trimmer housing 20*a* for trimming hair to a desired hair style. The comb 26 has a plate portion 28 and an arcuate tooth portion 27 (see FIG. 3). More specifically, the trimmer housing 20*a* is configured to be an arch structure that has an arcuate perforated screen 23 being arranged substantially as the top portion of the trimmer housing 20*a* between the blade (not shown) and the comb 26. The arcuate tooth portion 27 of the comb 26 is configured in conformity with the arcuate perforated screen 23. The plate portion 28 of the comb 26 is releasably and slidably mounted on a first portion 20*a*1 of the trimmer housing 20*a* below the arcuate perforated screen 23 that allows the arcuate tooth portion 27 of the comb 26 to be selectively spaced from the arcuate perforated screen 23, whereby hair inserted into the perforated screen 23 is selectively limited by the comb 26 for controlling the trimmed length of the hair.

The trimmer housing 20*a* defines two parallel upright grooves 24 to respectively receive two opposite side edges of the plate portion 28 of the comb 26. The distance between the comb 26 and the blade 16 in the trimming housing 20*a* may be adjusted by moving the plate portion 28 of the comb 26 upwardly or downwardly to increase or decrease the trimmed length of the hair.

The primary feature of the present invention resides in that the combination of hair combing trimmer, shaver and head side profile cutter is made in a separable form that allows the hair combing trimmer 20 to be integrally removed from the main body 10 to be replaced with a second device, preferably another trimmer, a shaver or a head side profile cutter.

To achieve the purpose, the main body 10 may be provided with a pair of parallel elongate grooves 14 (see FIG. 2) respectively defined in a mounting face 15 near two longitudinal edges thereof whilst the trimmer housing 20*a* is provided with at least two protruding fins 22 (although four protruding fins 22 are shown in FIG. 2) respectively at two longitudinal bottom inner edges of the trimmer housing 20*a* to be slidably inserted into a corresponding elongate groove 14 defined in the mounting face 15. In such an arrangement, the hair combing trimmer 20 is allowed to be releasably mounted onto the main body 10 by slidingly engaging the protruding fins 22 into the corresponding grooves 14 from the lateral side of the main body 10.

Figure 4:
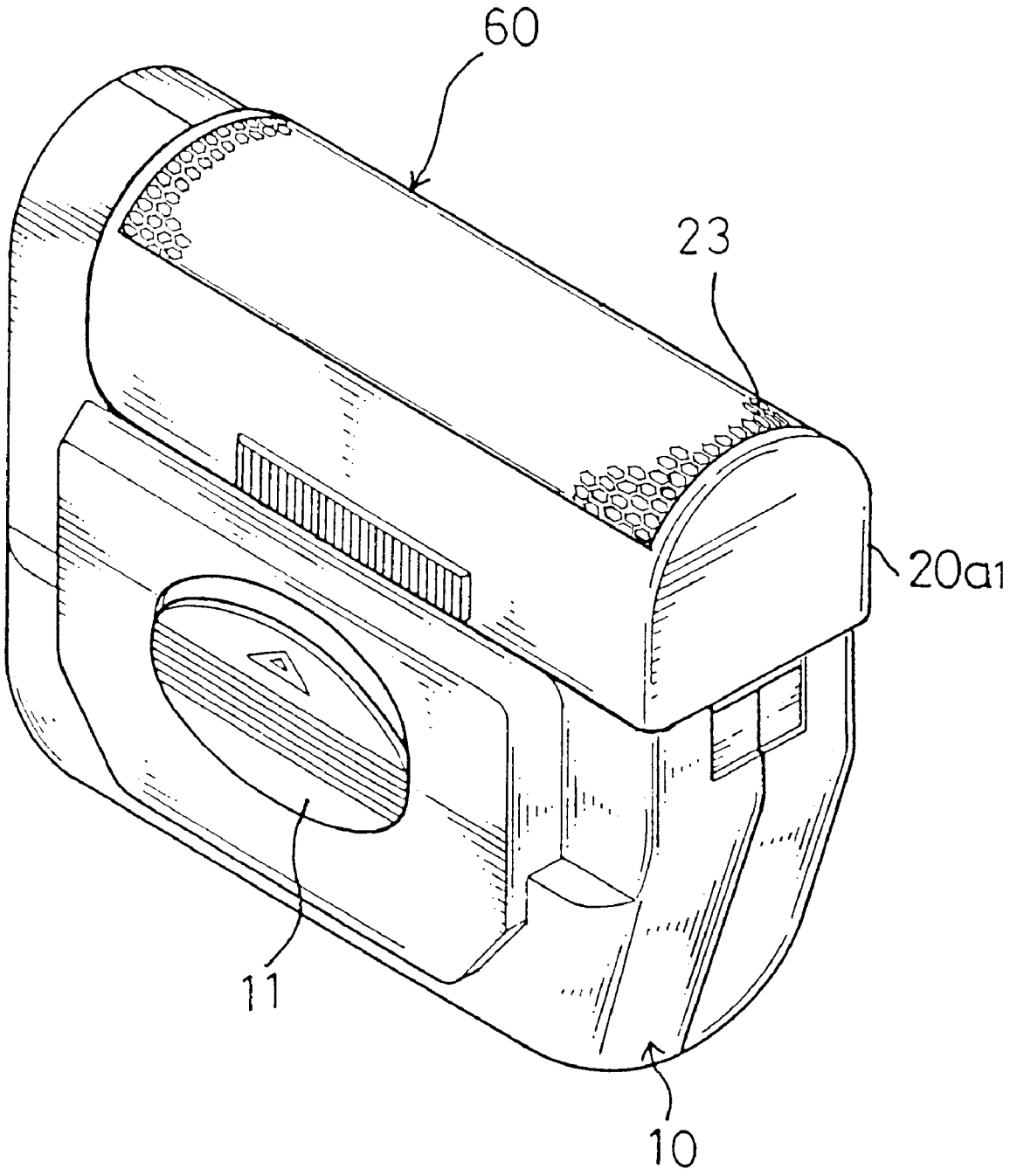
FIG. 4 is a perspective view of a second assembly of a cutting device combination in which a shaver is mounted and un arcuate perforated screen of the shaver extends further downwardly to a bottom thereof.

Referring to FIG. 4, a second assembly of the combination of hair combing trimmer, shaver, and head side profile cutter is disclosed, in which the trimmer 20 of the previous assembly is replaced with a shaver 60 which is deemed to be a second feature of the present invention. As shown, the shaver 60 has a structure substantially the sane as the hair combing trimmer 20 except that the arcuate perforated screen 23 is configured to extend further downwardly to terminate at a point close to the bottom of the shaver 60; the shaver is without a comb mounted thereto. In such an arrangement, the present invention may be used as an electrical razor to cut the chin stubble of a user.

More specifically, as shown in FIG. 2, a driving socket 12 may be mounted in the main body 10 to be rotated by the power and transmission unit (not shown). As can be seen in various conventional shavers or trimmers, the blade 16 is rotatably mounted on an axle 18 in the trimmer housing 20*a* or the shaver housing, the axle 18 being provided with a driving pinion 21 which is in turn couplingly fitted into the driving socket 12 mounted in the main body 10 so that the driving socket 21 can be driven into rotation through the power supply and transmission unit (not shown).

Figure 5:
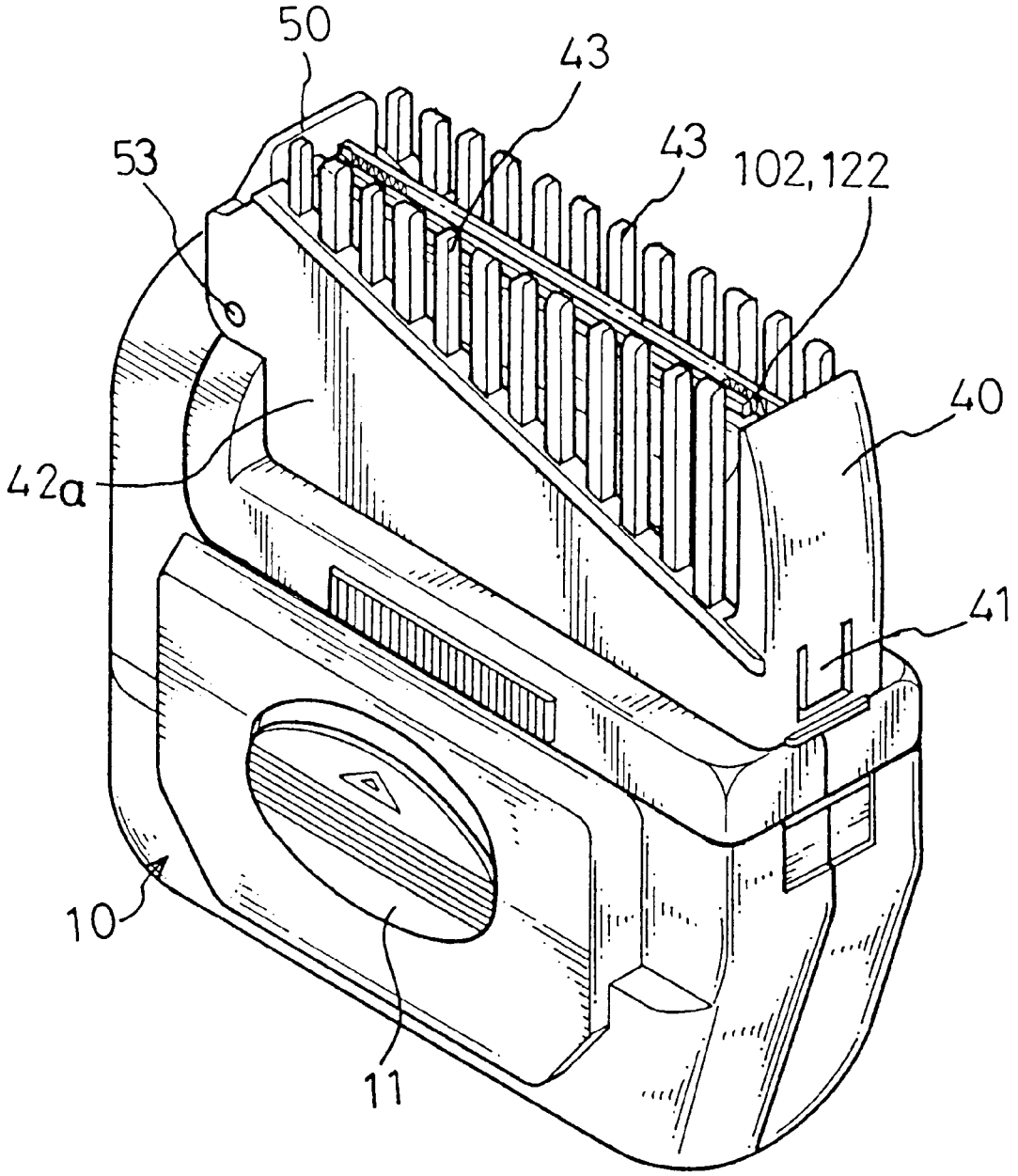
FIG. 5 is a perspective view of a third assembly of the cutting device combination in accordance with the present invention, in which a head side profile cutter is mounted.
Figure 6:
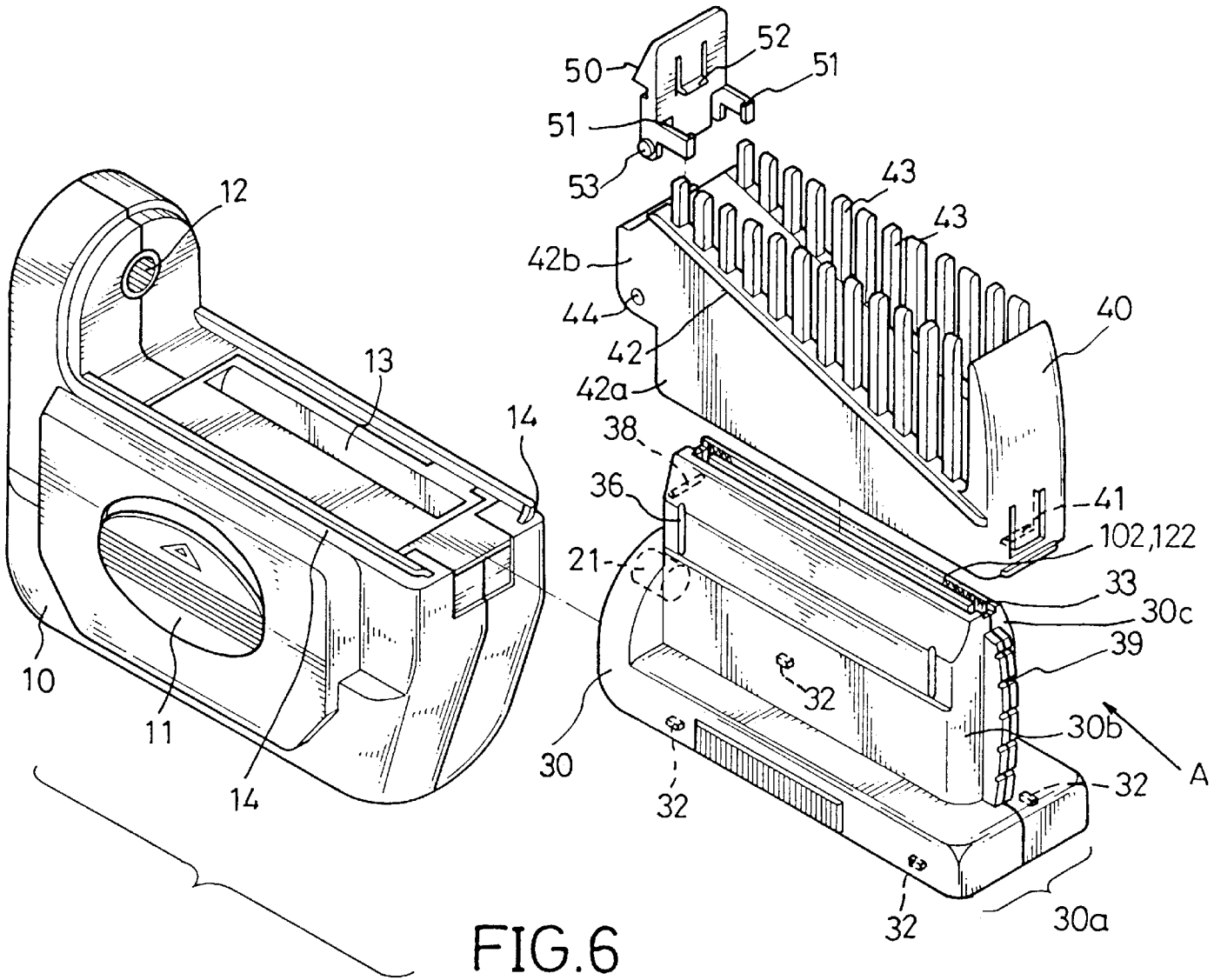
FIG. 6 is an exploded view of the third assembly.
Figure 10:
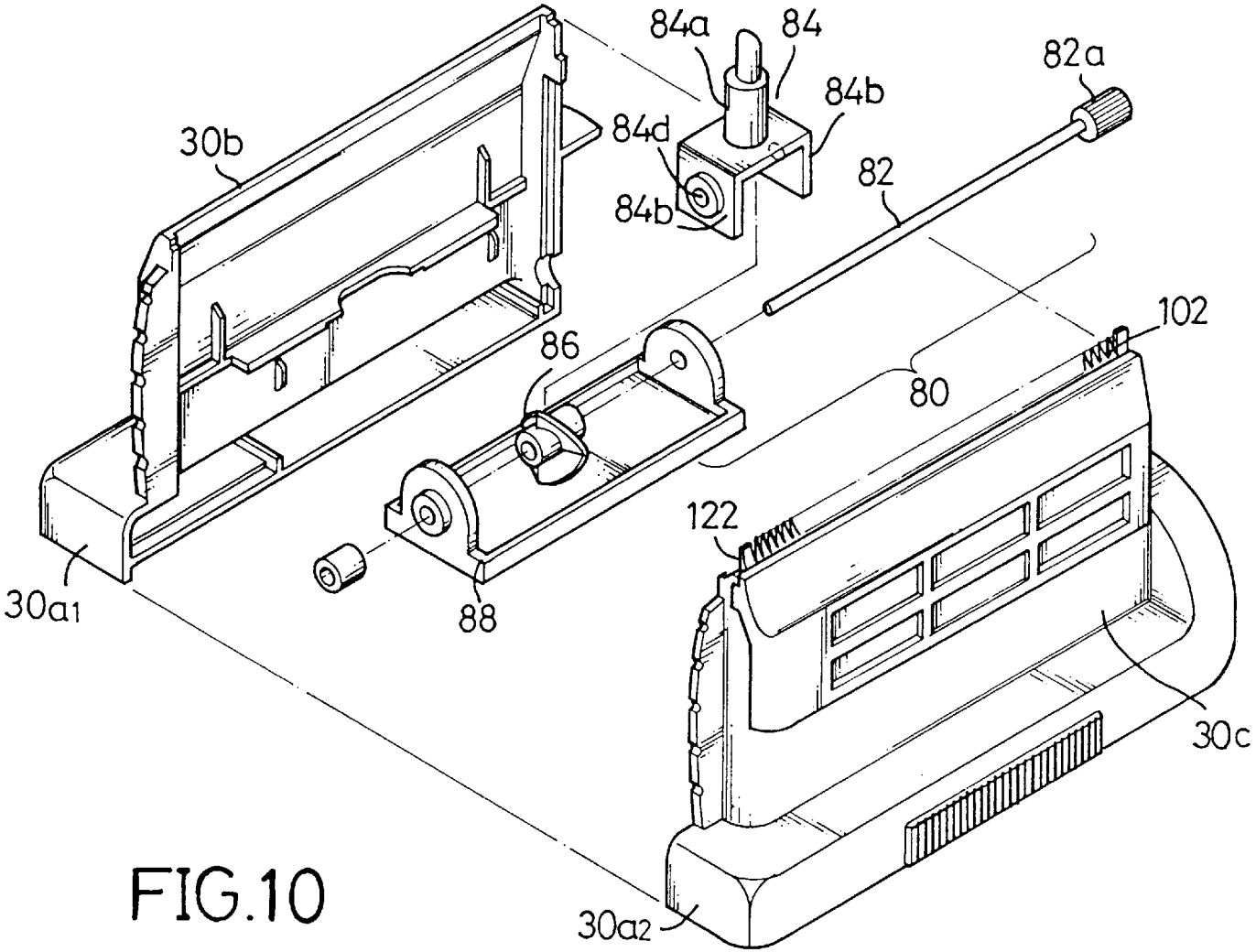
FIG. 10 is an exploded view of a head side profile cutter for use in the cutting device assembly.
Figure 12:
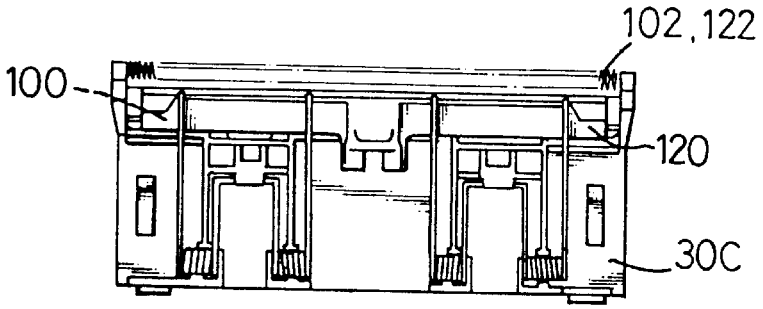
FIG. 12 is a plan view showing the arrangement of a first elongate blade and a second elongate blade mounted on a second wall portion of the head side profile cutter housing.
Figure 13:
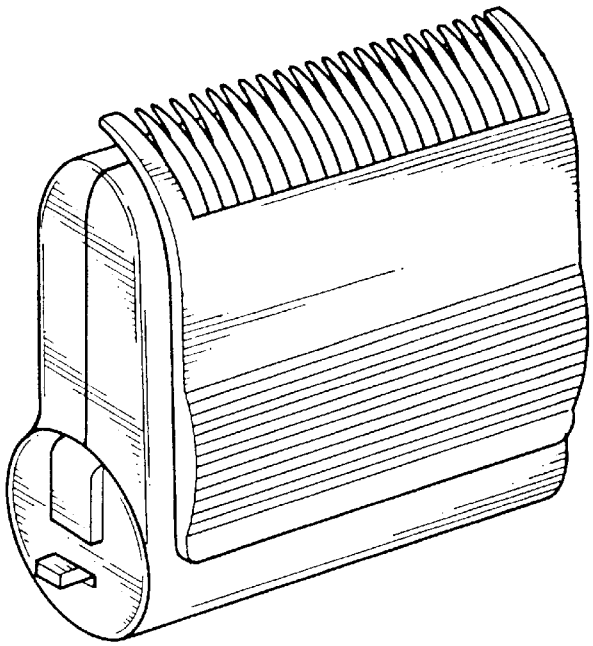
FIG.13 PRIOR ART
FIG. 13 is a perspective view of a convention hair combing trimmer.
Figure 14:
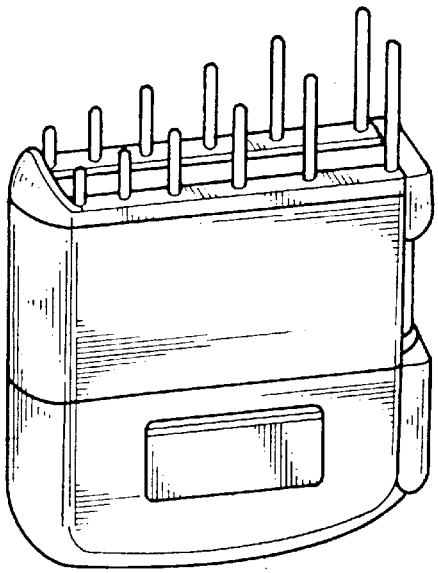
FIG.14 PRIOR ART
FIG. 14 is a perspective view of a conventional head side profile cutter.

Turning now to FIGS. 5 and 6, a third assembly of the combination of hair combing trimmer, shaver, and head side profile cutter in accordance with the present invention is disclosed, which includes the previous main body 10, a head side profile cutter being allowed to be releasably mounted onto the main body 10, and a second comb 40. A third feature of the present invention resides in the head side profile cutter 30, which is configured substantially to be a flat rectangular structure which has an elongate converging tip edge when viewed along the direction of the arrow A (see FIG. 6). The profile cutter 30 is also provided with at least two protruding fins 32 (although four protruding fins 32 are shown in FIG. 6) respectively at two longitudinal bottom inner edges of the profile cutter 30 to be slidably inserted into a corresponding one of the elongate grooves 14 defined in the mounting face 15 (in the same manner as the aforementioned trimmer or shaver), whereby the profile cutter 30 is allowed to be releasably mounted onto the main body 10. As shown in FIGS. 6 and 10, the profile cutter 30 includes a housing which is composed of a bottom portion 30*a*, a first wall portion 30*b* and a second wall portion 30*c*, a converting mechanism 80, a first elongate blade 100, and a second elongate blade 120. The bottom portion 30*a* includes a first half bottom portion 30*a*1 and a second half bottom portion 30*a*2 which defines a lower space (not labelled). The first wall portion 30*b* is integrally formed with the first half bottom portion 30*a*1. The second wall portion 30*c*, which is integrally formed with the second half bottom portion 30*a*2, is releasably mounted with the first wall portion 30*b* to define an upper space (not labelled) and an elongate slot 33 (see FIG. 6) along the top edges of the first wall portion 30*a* and the second wall portion 30*b*. The converting mechanism 80 is mounted in the lower space (not labelled) within the bottom portion 30*a* which is allowed to be driven by the aforementioned power supply and transmission unit (not shown) mounted in the main body 10. The first elongate blade 100 (under the second elongate blade 120 as seen in FIG. 12) is fixedly mounted to one of the first wall portion 30*b* and the second wall portion 30*c* (FIGS. 10 and 12 showing the blade 100 is mounted to the second wall portion 30*c*) along the top edge thereof. The first elongate blade 100 has a plurality of consecutive teeth 102 formed thereon, each tooth being arranged to project beyond the respective top edge of the first wall portion 30*b* and the second wall portion 30*c*. The second elongate blade 120, which has a plurality of consecutive teeth 122 formed thereon, is spring-biasedly mounted to one of the first wall portion 30*b* and the second wall portion 30*c* by two springs to afford the second elongate blade 120 a restoring force (FIGS. 10 and 12 showing the second elongate blade 120 is mounted to the second wall portion 30*c*), adjacent to and flush with the first elongate blade 100. The second elongate blade 120 is reciprocally driven by the converting mechanism 80 to be reciprocally moved relative to the first elongate blade 100. The reciprocal movement of the second elongate blade 120 relative to the first elongate blade 100 may allow hair or sideburns to be trimmed to a desired hair style.

Figure 11:
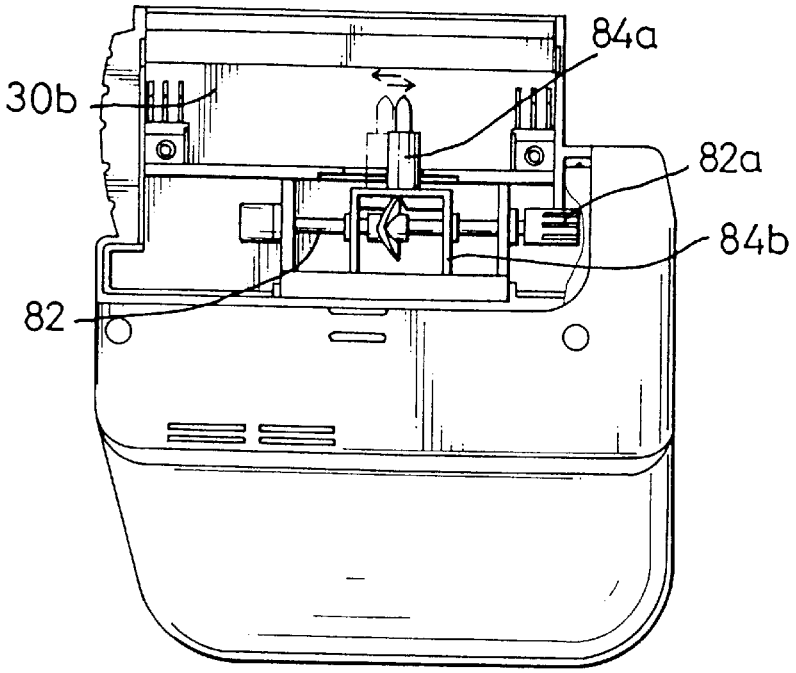
FIG. 11 is a schematic view illustrating the operation of a converting mechanism mounted in the head side profile cutter housing.

More specifically, as can be seen in FIG. 10, the converting mechanism 80 includes an axle 82, a substantially inverted Y-shaped slider 84 and a cam 86. The axle 82 is mounted on a base block 88 which is in turn mounted in the lower space (not labelled) defined in the bottom portion 30*a* of the profile cutter 30. The substantially inverted Y-shaped slider 84 has a central stem 84*a* for coupling with the second elongate blade 120 and two laterally downward extending legs 84*b* each defining a hole 84*d* therethrough to receive the axle 82. The cam 86 is coaxially and fixedly mounted to the axle 82 between the two laterally downward extending legs 84*b* of the inverted Y-shaped slider 84 which is engageable therewith. The axle 82 is provided with a driving pinion 82*a* to be couplingly inserted in the driving socket 12 mounted in the main body 10. The cam 86 has a profile configuration which enables the inverted Y-shaped slider 84 to be moved reciprocally, whereby when the axle 82 is rotated by the power and transmission unit (not shown) mounted in the main body 10, the second elongate blade 120 may conduct reciprocal movement with respect to the first elongate blade 100, as can be seen in FIG. 11. Under such a circumstance (without using the second comb 40), the head side profile cutter 30 is allowed to be used as an electrical razor to cut sideburns.

Figure 7:
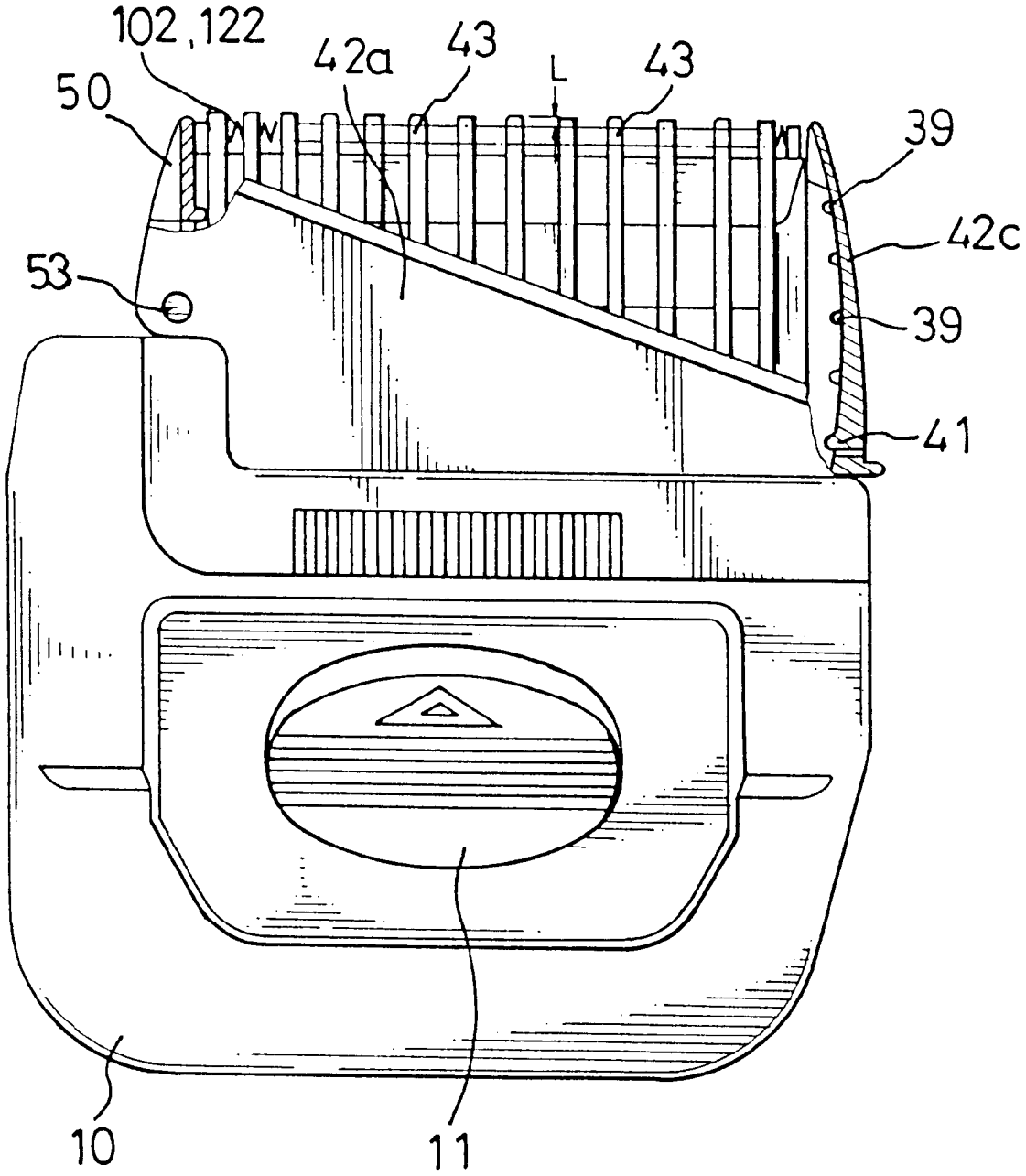
FIG. 7 is a plan view of the third assembly of the cutting device combination in which a comb is horizontally mounted on its associated main body.
Figure 8:
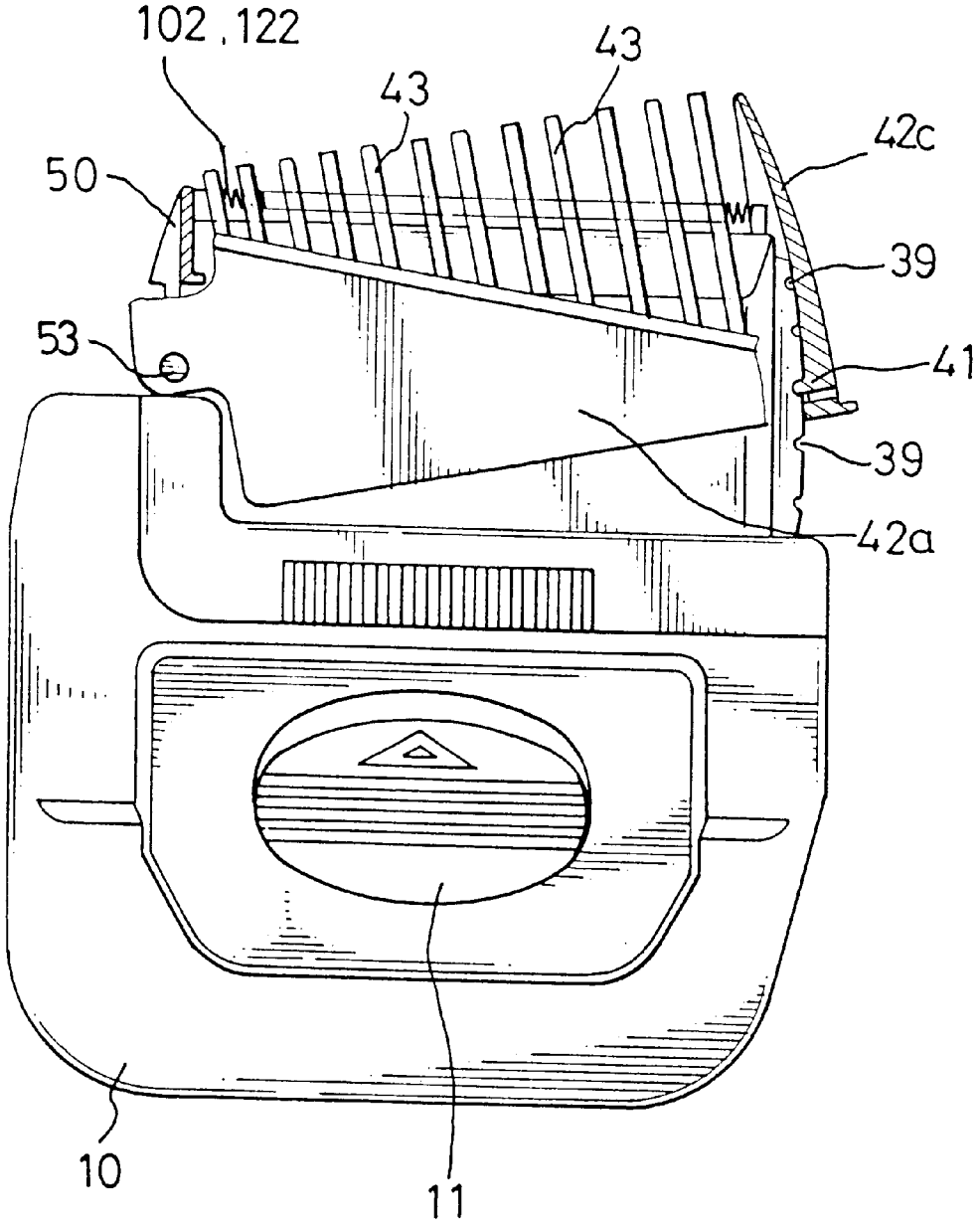
FIG. 8 is a plan view of the third assembly of the cutting device combination in which the comb is pivotally raised upwardly to adjust the trimmed length of the hair.

Referring to FIG. 6, a fourth feature of the present invention resides in the second comb 40, which is configured to have a bottom comb frame 42 and two parallel rows of comb teeth 43. The bottom comb frame 42 is composed of two parallel substantially triangular plates 42*a* each generally having an upright straight side, a bottom straight side, and a bevel straight side (not labelled), a neck portion 42*b* integrally formed between the upright straight sides of each of the two substantially triangular plates 42*a,* and an upright fang-like portion 42*c* integrally formed between the two substantially triangular plates opposite to the neck portion 42*b* to form a substantially four-sided enclosure which is allowed to be enclosingly fitted onto the profile cutter 30. Each of the comb teeth 43 extends upwardly from the bevel straight side of the respective substantially triangular plate 42*a* of the bottom comb frame 42 to a predetermined height that allows each comb tooth to be flush with each other and extends beyond the elongate blades 100, 120 at a predetermined length L (see FIG. 7). In such an arrangement, the length of hair to be cut by the elongate blades 100, 120 can be limited by the comb teeth 43, which is according to the length L between the tip of each comb tooth and the blades 100, 120. As shown in FIGS. 7 and 8, the bottom comb frame 42 is pivotally mounted with one lateral side of each of the first wall portion 30*b* and the second wall portion 30*c* that allows the comb teeth 43 to be raised upwardly (see FIG. 8) or downwardly for controlling the trimmed length of the hair.

More specifically, as shown in FIG. 6, the bottom comb frame 42 of the second comb 40 may be pivotally mounted on one lateral side of each of the first and second wall portions 30*b,* 30*c* of the profile cutter 30 via a pivoting leaf 50 which is composed of two first inserting tongues 51 laterally formed and a second inserting tongue 52 formed centrally, each first inserting tongue 51 being provided with a pivot pin 53 to be received in a corresponding pin hole 44 defined in the respective substantial triangular plate 42*a* near the neck portion 42*b*. The lateral side of the first and second wall portions 30*b,* 30*c* of the profile cutter housing are each provided with a first indentation 36 for receiving a respective one of the first inserting tongues 51 of the pivoting leaf 50 whilst a portion in the conjunction of the first and second wall portions 30*b,* 30*c* of the profile cutter housing is provided with a second indentation 38 for receiving the second inserting tongue 52 of the pivoting leaf 50. Furthermore, a series of notches 39 is defined along a portion in the conjunction of the first and second wall portions 30*b,* 30*c* of the profile cutter housing opposite to the second indentation 38 whilst a third tongue 41 is formed on the fang-like portion 42*c* of the comb 40 to be selectively snap-fitted into one of the notches 39 so that the second comb 40 is allowed to be retained in a temporary pivoting position that allows the comb teeth to extend beyond the elongated blades 100, 120 at a selected amount for trimming the hair quantitatively.

Figure 9:
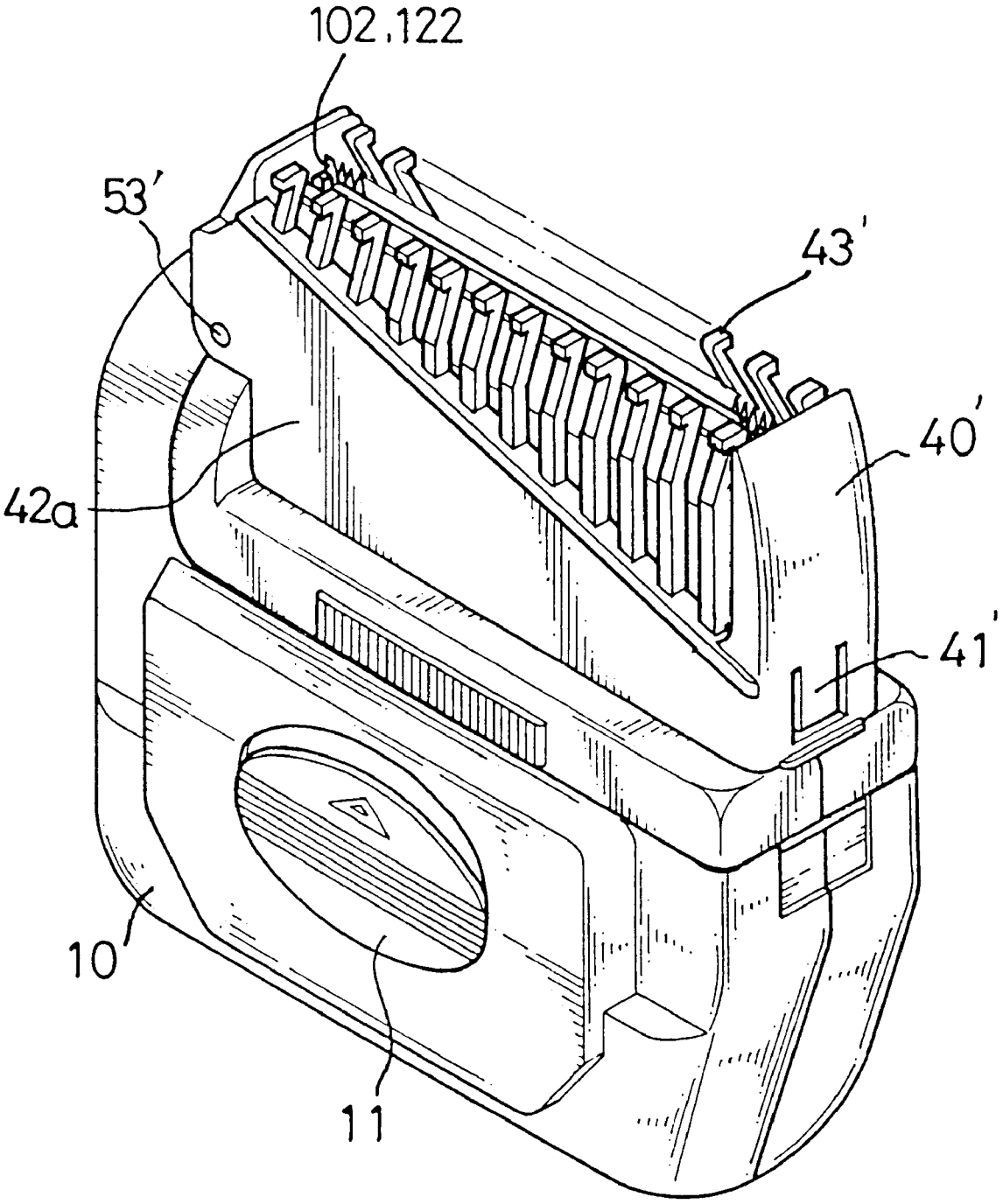
FIG. 9 is a perspective view of a modified third assembly of the cutting device combination in which the comb teeth thereof are locally modified.

Referring to FIG. 9, a fifth feature of the present invention resides in a modified second comb 40', which is particularly useful for a person with curly hair. The modified second comb 40' is the same as the aforementioned second comb apart from that the tip of each comb tooth 43' is curved outwardly with respect to the longitudinal axis of the modified second comb 40'.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

What is claimed is:

1. A cutting device combination, comprising:

a main body including a power supply and transmission unit mounted therein, a driving socket mounted in said main body and driven into rotation by a power supply and transmission unit, and defining a reservoir therein for receiving hair clippings;

a cutting head, which is selected from the group consisting of a hair combing trimmer, a shaver, and a head side profile cutter, capable of being integrally and releasably mounted onto said main body; wherein:

said hair combing trimmer including a trimmer housing, a blade mounted in said trimmer housing, and a trimmer comb mounted on said trimmer housing, wherein said blade is rotatably mounted on an axle longitudinally mounted in said trimmer housing, said axle being provided with a driving pinion which is in turn couplingly fitted into said driving socket mounted in said main body so that said driving socket can be driven into rotation through said power supply and transmission unit, and wherein said trimmer housing is configured to be an arch structure having an arcuate perforated screen integrally formed as one part of said trimmer housing, said arcuate perforated screen being arranged substantially as the top portion of said trimmer housing between said blade and said comb, said comb having a plate portion and an arcuate tooth portion being configured in conformity with said arcuate perforated screen, said plate portion of said comb being releasably and slidably mounted on a portion of said trimmer housing below said arcuate perforated screen that allows said tooth portion of said comb to be selectively spaced from said arcuate perforated screen for controlling the trimmed length of hair;

said shaver including a shaver housing, a blade mounted in said shaver housing, wherein said blade is rotatably mounted on an axle longitudinally mounted in said shaver housing, said axle being provided with a driving pinion which in turn couplingly fitted into said driving socket mounted in said main body so that said driving socket can be driven into rotation through said power supply and transmission unit, and wherein said shaver housing is configured to be an arch structure having an arcuate perforated screen integrally formed as one part of said shaver housing, said arcuate perforated screen being arranged as the top portion of said shaver housing, said arcuate perforated screen extending downwardly to terminate at a point close to the bottom of said shaver housing;

said head side profile cutter including a cutter housing, a first elongate blade together with a second elongate blade mounted in said cutter housing, and a cutter comb pivotally mounted on said cutter housing, wherein said cutter housing includes a bottom portion including a first half bottom portion and a second half bottom portion, a first wall portion, and a second wall portion, said bottom portion defining a lower space in which a converting mechanism is mounted which is in turn coupled with said driving socket, said first wall portion being integrally formed with said first half bottom portion, said second wall portion being integrally formed with said second half bottom portion, said first wall portion being releasably mounted with said second wall portion to define an upper space therein and an elongate slot along their top edges, wherein one of said first wall portion and said second wall portion has fixedly attached thereto along the top edge thereof the said first elongate blade and has spring biasedly mounted thereto the said second elongate blade which is longitudinally driven by said converting mechanism to allow said second elongate blade to be reciprocally moved relative to said first elongate blade, wherein said first elongate blade and said second elongate blade each having a plurality of consecutive teeth formed thereon, each said tooth being arranged to project from the respective top edge of said first wall portion and said second wall portion, whereby the reciprocal movement of said second elongate blade relative to said first elongate blade may allow hair or sideburns to be trimmed.

2. A cutting device combination as recited in claim 1, wherein said main body is provided with a pair of parallel elongate grooves respectively defined in a mounting face near two longitudinal edges thereof, each of said trimmer housing, said shaver housing, and said cutter housing is provided with at least two protruding fins respectively at two longitudinal bottom inner edges of said housing to be inserted into a corresponding elongate groove defined in said mounting face of said main body, whereby each of said hair combing trimmer, said shaver, and said head side profile cutter is allowed to be releasably mounted onto said main body.

3. A profile cutter adapted to be mounted on a main body defining a driving socket for cutting the side section of hair, comprising:

a housing including a bottom portion, a first wall portion, and a second wall portion, wherein:

said bottom portion including a first half bottom portion and a second half bottom portion, which defines a lower space;

said first wall portion integrally formed with said first half bottom portion;

said second wall portion integrally formed with said second half bottom portion and releasably mounted with said first wall portion to define an upper space therein and an elongate slot along the top edges of said first wall portion and said second wall portion;

a converting mechanism mounted in said lower space within said bottom portion which is adapted to be driven into movement by a power supply and transmission unit, said converting mechanism including:

an axle mounted in said lower space defined in said bottom portion of said housing;

a substantially inverted Y-shaped slider which has a central stem for coupling with said second elongate blade and two laterally downward extending legs each defining a hole to receive said axle; and a cam coaxially and fixedly mounted to said axle between said two laterally downward extending legs of said inverted Y-shaped slider engageable therewith, said axle being provided with a driving pinion to be couplingly inserted in said driving socket, said cam having a profile configuration to drive said inverted Y-shaped slider to move reciprocally so that when said axle is rotated by the power supply and transmission unit, said second elongate blade may conduct reciprocal movement with respect to said first elongate blade to trim hair or sideburns;

a first elongate blade fixedly mounted to one of said first wall portion and said second wall portion along the top edge thereof, said first elongate blade having a plurality of consecutive teeth formed thereon, each said tooth being arranged to project from the respective top edge of said first wall portion and said second wall portion; and a second elongate blade spring-biasedly mounted to said one of said first wall portion and said second wall portion, adjacent to and flush with said first elongate blade, said second elongate blade being reciprocally driven by said converting mechanism to be reciprocally moved relative to said first elongate blade, said second elongate blade having a plurality of consecutive teeth; whereby the reciprocal movement of said second elongate blade relative to said first elongate blade may allow hair or sideburns to be trimmed to a desired hair style.

4. In a cutting device of the type that comprises a main body and a cutting head, said main body having a power supply and transmission unit mounted therein and defining a reservoir therein for receiving hair clippings, said cutting head including a housing, a blade mounted in said housing, and a comb mounted on said housing for cooperation with said blade for trimming hair, said comb being spaced from said blade at a predetermined controllable distance whereby said blade may conduct a cutting movement via said power supply and transmission unit, whereby the hair is allowed to be trimmed by the blade at a desired length by adjusting the distance between said comb and said blade; wherein said cutting device is made in a separable form that allows said cutting head to be integrally removed from said main body to be replaced with a second cutting head, said main body has a mounting face containing two parallel grooves, said housing of said cutting head includes at least two protruding fins each formed on the bottom thereof to be inserted into a corresponding groove defined in said mounting face, whereby said cutting head is allowed to be releasably mounted onto said main body, and a driving socket is mounted in said main body, and is driven into rotation by said power supply and transmission unit; and wherein said blade is rotatably mounted on an axle longitudinally mounted in said housing of said cutting head, said axle being provided with a driving pinion which is in turn couplingly fitted into said driving socket mounted in said main body so that said driving socket can be driven into rotation through said power supply and transmission unit, and wherein said housing is configured to be an arch structure having arcuate perforated screen integrally formed as one part of said housing, said arcuate perforated screen being arranged substantially as the top portion of said housing between said blade and said comb, said comb having a plate portion and an arcuate tooth portion being configured in conformity with said arcuate perforated screen, said plate portion of said comb being releasably and slidably mounted on a first portion of said housing below said arcuate perforated screen that allows said tooth portion of said comb to be selectively spaced from said arcuate perforated screen for controlling the trimmed length of hair; said arcuate perforated screen extends downwardly to terminate at a point close to the bottom of a second portion of said cutting head opposite to said first portion below said arcuate perforated screen; and wherein said housing of said cutting head defines two parallel upright grooves to respectively receive two opposite side edges of said plate portion of said comb.

5. A cutting device as recited in claim 4, wherein said blade is configured to be a first elongate blade together with a second elongate blade, said housing includes a bottom portion including a first half bottom portion, and a second half bottom portion, a first wall portion, and a second wall portion, said bottom portion defining a lower space in which a converting mechanism is mounted which is in turn coupled with said driving socket, said first wall portion being integrally formed with said first half bottom portion, said second wall portion being integrally formed with said second half bottom portion, said first wall portion being releasably mounted with said second wall portion to define an upper space therein and an elongate slot along their top edges, wherein one of said first wall portion and said second wall portion has fixedly attached thereto along the top edge thereof the said first elongate blade and has spring biasedly mounted thereto the said second elongate blade which is longitudinally driven by said converting mechanism to allow said second elongate blade to be reciprocally moved relative to said first elongate blade, wherein said first elongate blade and said second elongate blade each having a plurality of consecutive teeth formed thereon, each said tooth being arranged to project from the respective top edge of said first wall portion and said second wall portion, whereby the reciprocal movement of said second elongate blade relative to said first elongate blade may allow hair or sideburns to be trimmed.

6. A cutting device as recited in claim 5, wherein said converting mechanism includes an axle mounted in said bottom portion of said housing, a substantially inverted Y-shaped slider which has a central stem coupled with said second elongate blade and two downwardly extending legs each defining a hole to receive said axle of said converting mechanism, and a cam coaxially and fixedly mounted to said axle of said converting mechanism between said two downwardly extending legs of said inverted Y-shaped slider, said axle of said converting mechanism being provided with a pinion to be couplingly received in said driving socket, said cam having a profile configuration to drive said central stem to move reciprocally so that when said axle of said converting mechanism is rotated by said driving socket coupled with said pinion, said second elongate blade may conduct reciprocal movement to trim hair or sideburns.

7. A cutting device as recited in claim 6, wherein said comb is configured to have a bottom comb frame and two parallel rows of comb teeth, said bottom comb frame including two parallel substantial triangular plates each generally having an upright straight side and a bottom straight side and a bevel straight side, a neck portion integrally formed between said upright sides of each of said two substantially triangular plates, and an upright fang portion integrally formed between said two substantially triangular plates opposite to said neck portion to form a substantially four-sided enclosure which is allowed to be fitted onto said cutting head, each of said comb teeth extending upwardly from the bevel straight side of the respective substantially triangular plate of said bottom comb frame to a predetermined height that allows each comb tooth to be flush with each other and extends beyond said blades for trimming hair in a predetermined amount.

8. A cutting device as recited in claim 7, wherein said bottom comb frame of said comb is pivotally mounted on one lateral side of each of said first wall portion and said second wall portion of said cutting head that allows said comb teeth to be raised upwardly or downwardly for controlling the trimmed length of the hair.

9. A cutting device as recited in claim 8, wherein said bottom comb frame of said comb is pivotally mounted on one lateral side of each of first and second wall portions of said housing via a pivoting leaf with two first inserting tongues laterally formed and a second inserting tongue, each first inserting tongue being provided with a pivot pin to be received in a hole defined in the respective substantial triangular plate near said neck portion, wherein said lateral side of each said first and second wall portions of said housing are each provided with a first indentation for receiving a respective first inserting tongue of said pivoting leaf whilst a portion in the conjunction of said first and second wall portions of said cutting head is provided with a second indentation for interferedly receiving said second inserting tongue of said pivoting leaf.

10. A cutting device as recited in claim 9, wherein a series of notches is defined along a portion in the conjunction of said first and second wall portions of said housing whilst a third inserting tongue is formed on said fang portion of said comb to be selectively snap fitted into one of said notches so that said comb is allowed to be retained in a temporary pivoting position that allows the comb teeth to extend beyond said blades at a selected amount for trimming the hair in a desired quantity.

11. A cutting device as recited in claim 10, wherein the tip of each said comb tooth is outward curved with respect to a longitudinal axis of said comb.

12. A cutting device as recited in claim 11, wherein said housing of said cutting head, which includes said bottom portion, said first wall portion, and said second wall portion, is configured substantially to be a flat rectangular structure which has an elongate converging tip edge formed by the top edges of each of said first and second wall portions.

* * * * *